US005203045A

United States Patent [19]

Golston

[11] Patent Number: 5,203,045

[45] Date of Patent: Apr. 20, 1993

[54] NOZZLE MOUNTING IN ATMOSPHERIC DIFFUSERS

[75] Inventor: Stefan Golston, Bellevue, Wash.

[73] Assignee: Kamyr, Inc., Glens Falls, N.Y.

[21] Appl. No.: 775,499

[22] Filed: Oct. 15, 1991

[51] Int. Cl.[5] ..... D06B 1/02

[52] U.S. Cl. ..... 8/156; 68/181 R; 62/60; 62/251; 239/588

[58] Field of Search ..... 8/156; 68/181 R; 162/60, 251; 134/25.5; 137/68.1; 285/2, 3, 5, 6, 9.1; 210/40 S, 333.01, 456, 342, 334; 239/264, 732, 587.5, 587.6, 587.4, 587.1, 587.8, 725, 724, 728, 726, 730, 754, 751, 752

[56] References Cited

U.S. PATENT DOCUMENTS

| | | | |
|---|---|---|---|
| 2,706,133 | 4/1955 | North, Jr. et al. | 239/588 X |
| 2,910,245 | 10/1959 | Burroughs | 239/587.5 X |
| 3,158,324 | 11/1964 | Oehler et al. | 239/587.1 X |
| 3,339,845 | 9/1967 | Bond | 239/588 X |
| 3,352,573 | 11/1967 | Canning | 285/2 |
| 3,815,386 | 6/1974 | Gullichsen et al. | 68/181 R |
| 3,815,941 | 6/1974 | Synder | 285/283 |
| 4,172,037 | 10/1979 | Golston | 210/315 |
| 4,793,161 | 12/1988 | Richter et al. | 68/181 R |

*Primary Examiner*—Frankie L. Stinson
*Attorney, Agent, or Firm*—Nixon & Vanderhye

[57] ABSTRACT

Nozzle breakage in an atmospheric diffuser for treating paper pulp is precluded by mounting the nozzle to the rotating scraper arm by a connection which will break when the nozzle is subjected to a drag force of about 50% of the force that will break the nozzle. The connection preferably includes a pivot connection of a nozzle extension at one side of the arm, and a shear pin connection of the extension at the end opposite the pivot connection. An oblong nozzle is integral with the nozzle extension, with the fluid introducing openings of the nozzle remote from its connection to the extension. The amount of pivotal movement of the nozzle when the shear pin breaks is limited to about 15°-26° so as to prevent the nozzle from contacting an annular extraction screen of the diffuser.

27 Claims, 4 Drawing Sheets

NOZZLE MOUNTING IN ATMOSPHERIC DIFFUSERS

BACKGROUND AND SUMMARY OF THE INVENTION

The atmospheric diffuser is a normally very reliable and effective apparatus used for the treatment of paper pulp, typically for washing or bleaching the pulp. Atmospheric diffusers have been sold by Kamyr, Inc. of Glens Falls, New York for about 20 years and have performed effectively in a wide variety of circumstances. In a typical atmospheric diffuser, annular screens are mounted by extraction arms concentric with the vertical axis of the diffuser vessel, and are reciprocated up and down within the vessel, matching the flow speed of the pulp in the upstroke, and moving quickly in the downstroke to effect backflushing of the screens to preclude them from clogging. Nozzles for introducing the wash or bleach liquid are mounted on a scraper arm at the top of the vessel, and if a multi-stage diffuser is provided at another treatment arm at the bottom of each stage, and extend between the annular screens, introducing treatment liquid which flows through the pulp and then displaces liquid within the pulp, which is withdrawn through the extraction arms.

One of the few significant problems that can occur in operation of Kamyr atmospheric diffusers is nozzle breakage. As the treatment arms are rotated about the central vertical axis of the vessel, the nozzles are subjected to a drag force by the pulp. For the outer nozzles on the arm, which have a faster tangential velocity than the interior nozzles, this drag force can become quite significant, especially if some of the nozzles become clogged or another aberrant condition occurs that causes the resistance of the pulp at that particular nozzle to be greater than expected. If a nozzle breaks as a result of this drag force, pieces of the nozzle may affect the operation of the diffuser. In a number of cases physical damage to the interior of the diffusers was wrought by floating pieces of broken nozzle. Operation of the diffuser must be arrested and the nozzle replaced, and other adverse consequences can occur. The down time for replacing the nozzles can be significant.

According to the present invention, a method and apparatus are provided which substantially preclude nozzle breakage. According to the present invention, a connection between the nozzle and the treatment arm will become interrupted, rather than the nozzle breaking. This means that nozzle pieces will not break off into the diffuser creating a potential hazard, and the nozzles themselves need not be replaced in order to repair the diffuser.

In the preferred embodiment of the invention, the connection between the nozzle and the treatment arm assembly is provided by a nozzle extension having a pivot pin connection at one side end thereof, and a shear pin connection at the other side end thereof, to the arm assembly. A first end of the nozzle is integral with the extension, with the second end of the nozzle—containing the fluid introduction openings therein—vertically remote from the extension. The shear pin preferably has shear resistance properties that are about 50% of those of the nozzle, so that if the drag force on the nozzle is about 50% of the level that will break the nozzle, the shear pin will sever instead. It is a simple and inexpensive procedure to replace the shear pin compared to replacing the entire nozzle.

In order to prevent the second end of the nozzle from contacting one of the annular screens of the diffuser, the amount of pivotal movement of the nozzle once the shear pin fractures is limited, typically to about 15°-26°. This action is normally self-correcting for the condition that caused the drag force that resulted in shear pin fracture. Once the nozzle pivots away from the treatment arm, treatment fluid will flow freely into the pulp at that point, diluting the pulp substantially and thereby decreasing the drag force. This free flow of treatment fluid will also cause a pressure drop in the treatment fluid supply system, which can be noted by an operator who can then schedule the appropriate repair procedures.

It is the primary object of the present invention to minimize the possibility of nozzle breakage in an atmospheric diffuser. This and other objects of the invention will become clear from an inspection of the detailed description of the invention and from the appended claims.

DETAILED DESCRIPTION OF THE DRAWINGS

Figure 1:
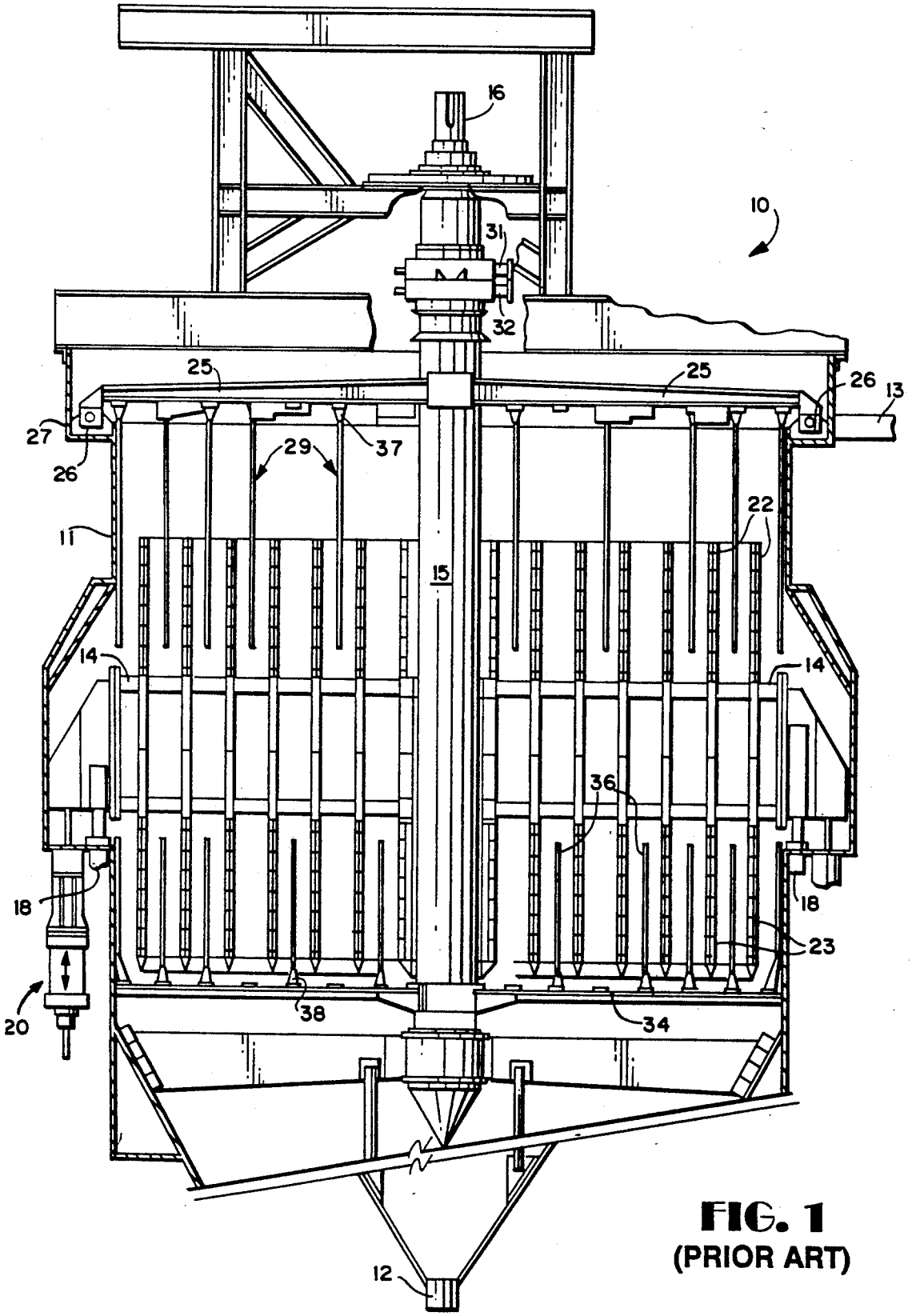
FIG. 1 (PRIOR ART)
FIG. 1 is a side view, partly in cross-section and partly in elevation, of an exemplary conventional prior art atmospheric diffuser.

An exemplary atmospheric diffuser which can contain the connections according to the invention is shown generally by reference numeral 10 in FIG. 1. The conventional components of the diffuser 10 include the generally upright vessel 11 having a pulp inlet 12 at the bottom thereof and a pulp outlet 13 at the top. A plurality of extraction arms 14 are mounted within the vessel, extending radially outwardly from the central shaft 15 which defines the central vertical axis of the vessel 11. Shaft end 16 is connected to a conventional motor (not shown). Outlets for displaced liquid from the extraction arms are provided at 18. A fluid cylinder 20, or like mechanism, is provided (preferably one associated with each arm 14) to effect up and down reciprocation of the extraction arms 14. The reciprocation is at essentially pulp flow velocity in the direction of pulp flow movement, and at a much higher speed opposite to the direction of pulp flow, as is conventional.

Mounted on the extraction arms 14 are a plurality of annular screens, such as a first plurality of screens 22 extending upwardly from the arms 14, and—in a multistage diffuser—a second plurality of screens 23 extending downwardly from the arms 14. Disposed above the screens 22 is a treatment/scraper arm assembly 25, having scrapers 26 thereof disposed in a top annular trough 27 in communication with the pulp outlet 13. The shaft 15, to which the arm assembly 25 is connected, is driven by the motor connected to the drive end 16, so that the arm assembly 25 rotates in a first direction of rotation, shown by arrows 28 in FIG. 2. Connected to the arm assembly 25 are a plurality of treatment fluid introducing nozzles 29 which are vertically elongated, and are disposed between the screens 22. The nozzles 29 are typically oblong in cross-section (see FIG. 2), and at a second end thereof, remote from the arm assembly 25, have means defining at least one fluid introducing opening 30, typically at the side of the nozzle 29 that trails as the nozzle 29 moves in the direction of rotation 28.

Figure 2:
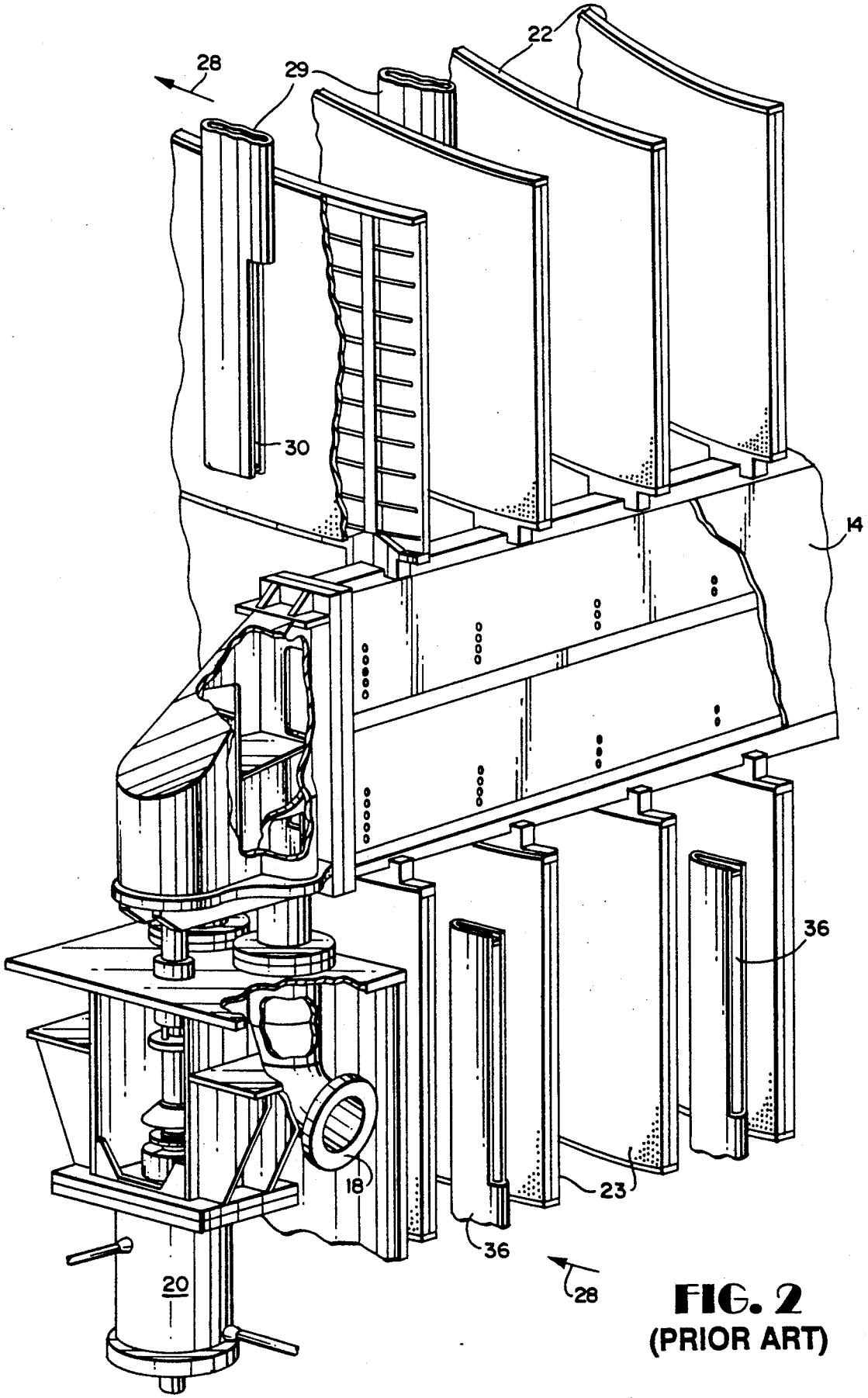
FIG. 2 (PRIOR ART)
FIG. 2 is a detail perspective view showing the interrelationship between the screens and nozzles of the diffuser of FIG. 1.

Treatment fluid is supplied to the nozzles 29 from a conduit 31 (FIG. 1) which extends interiorly of the shaft 15, and to the rotating treatment arms 25, the treatment fluid—typically wash liquid or bleach liquid—flowing through the arm assembly 25 and then to nozzles 29, to be introduced through the openings 30.

Where a multi-stage diffuser—a two stage diffuser being shown in FIGS. 1 and 2—is provided, at least a second conduit 32 is provided for introducing a second treatment fluid, that treatment fluid flowing through a conduit within the shaft 15 to the treatment arm assembly 34 to which the nozzles 36 are mounted, the nozzles 36 being disposed between the bottom set of annular screens 23, and essentially identical to nozzles 29.

As the nozzles 29, 36 move through the pulp in the direction of rotation 28, they will be subjected to a drag force. If this drag force is too high, the nozzles 29, 36 will fracture. The nozzles are typically made of titanium or stainless steel, and if they fracture they can have parts break off which might adversely affect the operation of the diffuser 10, or may clog other equipment associated with the diffuser 10. Therefore, according to the present invention, instead of providing a typical rigid connection 37 between the nozzles 29 and the arm assembly 25, or substantially identical rigid connection 38 between the nozzles 36 and the treatment arm 34, a connection that will yield when the nozzle is subjected when to a drag force much less than the force which will break the nozzle, is provided.

Figure 3:
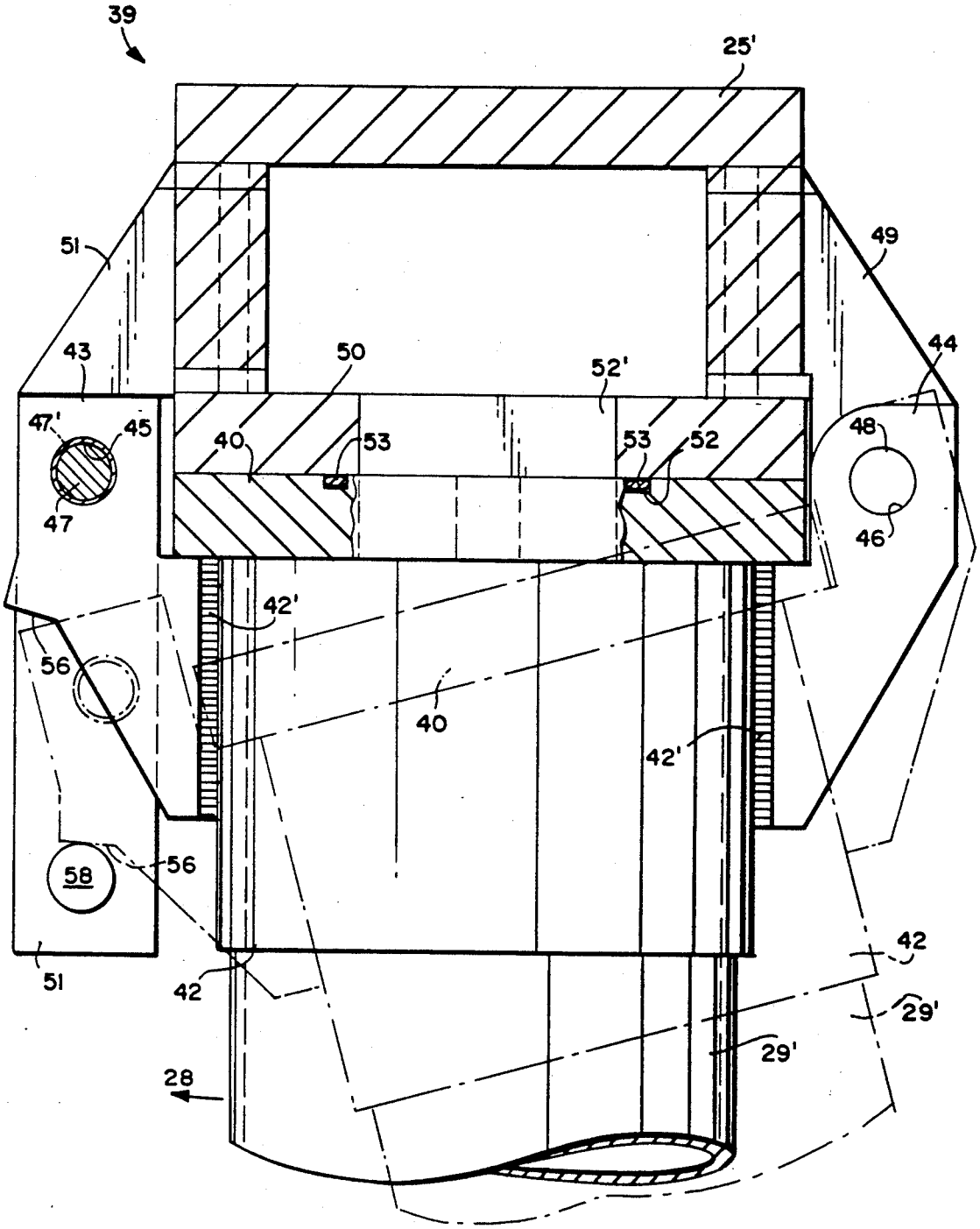
FIG. 3 is a side view, partly in cross-section and partly in elevation, of the connection between a nozzle and treatment arm according to the invention, the section taken along lines 3—3 of FIG. 4.
Figure 4:
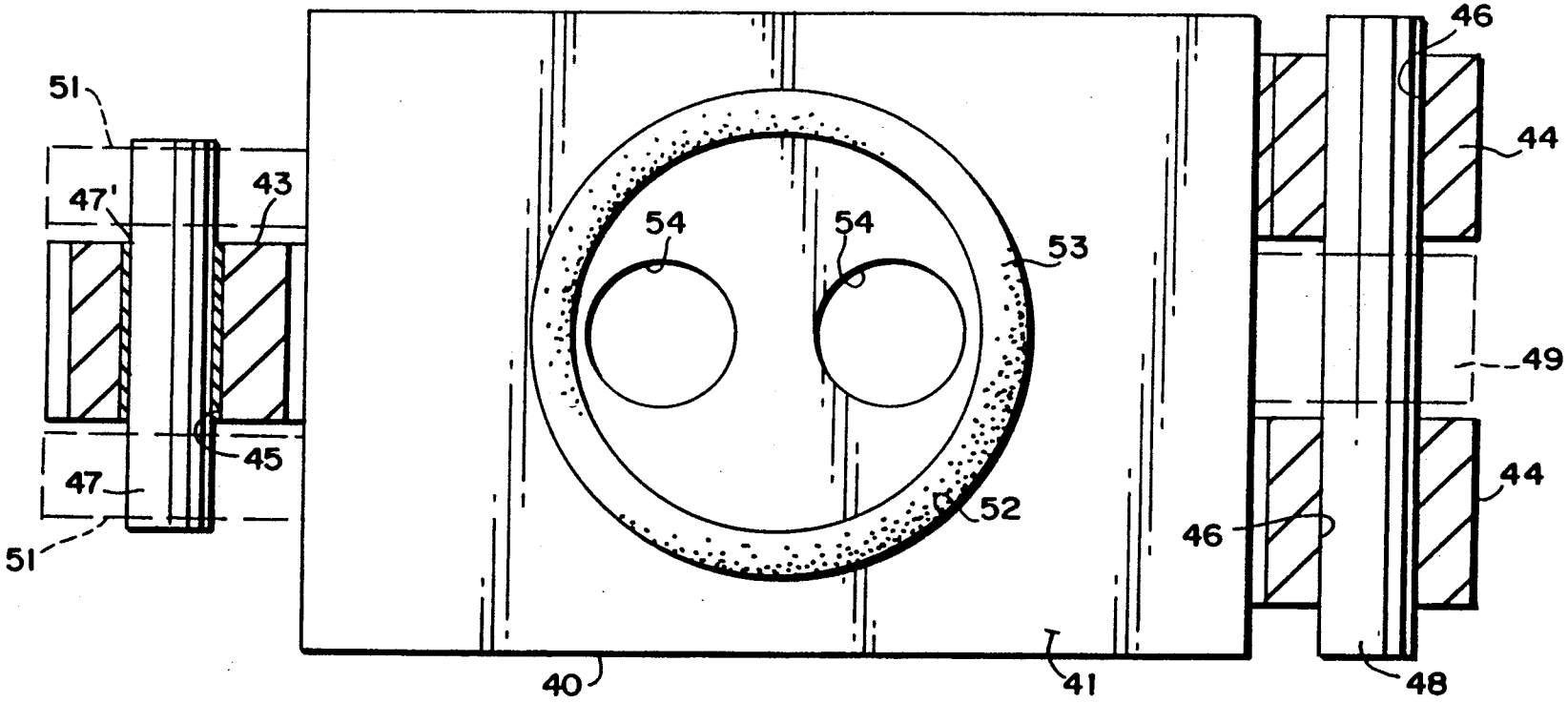
FIG. 4 is a top view of the nozzle extension top plate of the connection of FIG. 3.

An exemplary connection 39 between the nozzle 29' according to the invention, and a scraper/treatment arm 25' is shown in the drawings. Illustrated in FIGS. 3 and 4 is a fluid tight connection means 39 for connecting an oblong nozzle 29' to the arm 25' so that treatment fluid will normally flow from the arm 25' through the nozzle 29' (to be discharged through an opening at the second end thereof, remote from the arm 25', into the pulp) so that the connection will be broken if the nozzle 29' is subjected to a high drag load, but less than the load that will break that nozzle. The nozzle 29' and arm 25' are otherwise identical to their conventional counterparts 29, 25. Typically the connection 39 is designed to break if the nozzle 29' is subjected to a drag load that is about 50% of the load which will break the nozzle.

The connection 39 illustrated in FIGS. 3 and 4 includes a nozzle extension 42 which is integral with and of substantially the same cross-sectional shape (merely larger) as the nozzle 29'. Extension 42 has a rectangular plate 40 at one end thereof, including a planar (top) surface 41. The extension 42 is welded (see welds 42') to a pair of first ears 44 which extend outwardly from one end thereof (the end corresponding to the trailing end of the nozzle 29' as it moves in the direction of rotation 28), and a second ear 43, which extends outwardly from the opposite side of the body 42, that is from the end of the extension 42 corresponding to the leading edge of the nozzle 29' as it moves in its direction of rotation 28. Formed in the second ear 43 is a second through-extending opening 45, and formed in the first ears 44 are through-extending first openings 46. The openings 46, 45 are parallel, and perpendicular to the direction of elongation of the arm 25', and to the direction of rotation 28.

Received within the opening 45 is a shear pin 47, preferably within a sleeve 47'. Typically the diameter of the opening 45 is about one inch, while the sleeve 47' is made of a hard metal and has an outside diameter essentially the same as the inside diameter of the opening 45. The shear pin 47 is made of softer material and has a diameter equal to the inside diameter of the hard sleeve 47', which diameter will depend upon numerous parameters, including use of the diffuser, materials of construction, screen ring size, etc. Received within the openings 46 is a pivot pin 48 made of a hard metal, and, for example, having an outside diameter of about one inch, roughly the same as the diameter of the openings 46.

Pivotal connection of the extension 42 to the arm 25' is provided by the first portion 49 of the arm 25', and the second portions 51 thereof, with the bottom plate-like portion 50 of the arm 25' therebetween. The first portion 49 comprises an ear which has a thickness such that it is disposed between the ears 44 of the bushing 42, and has an opening therein comparable to and aligned with the openings 46 of the ears 44 so that the pivot pin 48 is also received thereby. The second portions 51 comprises two ears which are adjacent the ear 43 (straddling it, one portion 51 removed in FIG. 3 for clarity of illustration), and has an opening therein corresponding to the second opening 45 in the ear 43, receiving the shear pin 47 therein.

When the nozzle 29' is subjected to a high drag force as it moves in the direction 28 the shear pin 47 will shear, causing the nozzle 29' to pivot about the pivot pin 48 from the solid line position illustrated in FIG. 3 to the dotted line position illustrated therein. When the nozzle 29' is in the solid line position illustrated in FIG. 3, the O-ring 53 disposed in the annular groove 52 in the top planar surface 41 of the element 40 thereof is in sealing engagement with the bottom plate 50 of the arm 25', sealing opening 52' too. In this position, wash or bleach liquid from the arm 25' flows through the openings 54 in the element 40 into the interior of the nozzle 29', to be discharged from the bottom end thereof (through an opening comparable to the opening 30 illustrated in FIG. 2). However when the shear pin 47 fractures and nozzle 29' moves to the dotted line position in FIG. 3, treatment liquid flows freely through the opening 52' directly into the pulp surrounding the nozzle 29', diluting the pulp and preventing further damage. The opening 52' has a much larger area than the openings 54, so that much more treatment liquid will be introduced at the area of nozzle 29' in the solid line position illustrated in FIG. 3. This will also cause a sudden increase of flow at that nozzle, and a drop of pressure in the system, which could be either automatically detected, or observed by an operator, so that maintenance could be scheduled for the diffuser.

When the nozzle 29' pivots about the pivot pin 48, it is important to limit the amount of pivotal movement so that the second end of the nozzle 29, remote from the arm 25', does not contact an annular screen 22, which would damage the screen as the nozzle was being rotated in the direction 28. This limiting action is provided by the stop projection 56 extending outwardly from the ear 43, and the stop pin 58 associated with the arm second portions 51. Stop pin 58 extends parallel to the openings 45, 46, and is spaced from the stop projection 46 so that it is in the arcuate path of movement of the projection 56 about the pivot pin 48. Preferably the stop pin 58 is about 15° along the arcuate path of movement of the projection 56 from its solid line position in FIG. 3, although the angle will depend upon the spacing from the screens at that particular nozzle. Since in conventional diffusers the critical angle before the nozzle would contact a screen is between about 17° and 28°, a limit of 15° would preclude such damaging contact in each situation, yet would allow enough free flow of liquid through the opening 52' to allow dilution of the pulp in a surrounding area; but the angle can vary from about 15° to about 26°.

Connections identical to those illustrated in FIGS. 3 and 4, only "upside down", may be provided between the nozzles 36 and the arm assembly 34 associated with the lower screens 23. Also, the connections as illustrated in FIG. 3 need not be provided for every nozzle in a diffuser 10. Rather they will be provided, typically, in a first plurality of nozzles, namely those nozzles that historically are subjected to the most drag force. This may be the nozzles that are most remote from the shaft 15 since they move at the largest tangential velocity. However for some diffusers all of the nozzles associated with the diffuser may have the connections illustrated in FIGS. 3 and 4.

Utilizing the apparatus heretofore described, according to the present invention there is a method of treating paper pulp in an upright vessel 11 having a vertical axis (defined by shaft 15), with a plurality of annular screens 22 mounted on extraction arms 14 and concentric with the vertical axis, and a plurality of treatment arms 25 having treatment fluid introducing nozzles 29' connected thereto by connections 39 and disposed between the screens 22. The method comprises the steps of:

(a) Introducing paper pulp so that it flows vertically (e.g. upwardly) in the vessel 11 past the annular screens 22, from the inlet 12 to the outlet 13, liquid being withdrawn from the pulp within the vessel 11 through the screens 22 and extraction arms 14.

(b) Rotating the treatment arms 25' and attached nozzles 29' so that while introducing treatment fluid into the pulp through the nozzles, the treatment fluid flows through the treatment arms 25' into the nozzles 29'. A drag force is naturally applied to the nozzles as they move through the pulp in the first direction of rotation 28.

(c) Reciprocating the extraction arms 14, and attached screens 22, up and down utilizing the fluid cylinders 20. And, (d) should the drag force on a nozzle 29' become greater than a high predetermined value, but less than the amount of drag force that would break the nozzle 29', providing breaking of the connection 39 between the nozzle and the treatment arm 25' so that treatment fluid flows into the pulp directly from the treatment arm (i.e. through opening 52') rather than through the nozzle 29' (through openings 54, and then out the bottom of the nozzle), the treatment fluid diluting the pulp at the area of breakage so as to reduce the drag force at that point.

Step (d) is preferably practiced by causing pivotal movement, about pivot pin 48, at the first end plate 40 of the nozzle so that the second end thereof pivots opposite to the direction of rotation 28 of the treatment arm 25'. Step (d) is preferably further practiced by limiting the amount of pivotal movement to about 15°–26°, so that the second end of the nozzle 29' will not contact a screen 22. Step (d) is further practiced so that the predetermined value (that is the ability of the shear pin 47 to accept shear forces) is about 50% of the drag force that will break the nozzle 29'.

Once the freer flow of treatment liquid occurs at the nozzle where the connection 39 has opened up, the operator will be able to determine the pressure reduction that would occur in the line supplying treatment liquid to the arms 25', and thereby could schedule maintenance of the diffuser. When maintenance was effected, it would only be necessary to replace the shear pin 47, rather than the nozzle 29'.

It will thus be seen that according to the present invention a method and apparatus have been provided for substantially precluding the breakage of nozzles within an atmospheric diffuser.

While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and devices.

What is claimed is:

1. An atmospheric diffuser for treating paper pulp, comprising:

a generally upright vessel having a central vertical axis;

a plurality of annular screens;

means for mounting said annular screens within said vessel concentric with said central vertical axis;

means for reciprocating said mounting means up and down so that said screens move parallel to said central vertical axis;

a treatment arm assembly;

means for mounting said arm assembly within said vessel vertically spaced from said screens for rotation about said central axis;

means for rotating said arm assembly about said central axis in a first direction;

means for supplying treatment fluid to said arm assembly;

a plurality of elongated treatment fluid introduction nozzles for introducing treatment fluid into said vessel between said annular screens; and fluid tight connection means for effecting connection of a first plurality of said nozzles to said arm assembly so that said nozzles are vertical and disposed between said screens and so that treatment fluid will normally flow from said arm assembly into said nozzles and from said nozzles into the interior of said vessel, but so that the connection between each of said first plurality of nozzles and said arm assembly will be broken if a said nozzle is subjected to a high drag load, but less than the load which will break that nozzle.

2. A diffuser as recited in claim 1 wherein said arm assembly comprises a scraper arm mounted above said annular screens.

3. A diffuser as recited in claim 1 wherein each of said nozzles has first and second ends, said second end having at least one fluid introducing opening formed therein; and wherein said connecting means for each of said first plurality of nozzles comprises means for pivotally connecting the nozzle at said first end thereof to said arm assembly so that said nozzle will pivot with respect to said arm assembly with said second end thereof moving in a direction opposite to said first direction of rotation, to allow free flow of fluid from said arm assembly into the interior of said vessel if the nozzle is subjected to a high drag load, but less than the load which will break the nozzle.

4. A diffuser as recited in claim 3 further comprising means for limiting the amount of pivotal movement of each of said first plurality of nozzles with respect to said arm assembly in response to said high drag load so that said second end of a nozzle will not contact an annular screen.

5. A diffuser as recited in claim 4 wherein said limiting means comprises means for limiting the pivotal movement of each of said first plurality of nozzles to about 15°-26° from its normal vertical position.

6. A diffuser as recited in claim 3 wherein each of said means for pivotally connecting a nozzle of said first plurality of nozzles to said arm assembly comprises a pivotal connection at a first side of said nozzle; and wherein said connecting means further comprises a shear pin mounted on a second side of the nozzle, opposite said first side.

7. A diffuser as recited in claim 6 wherein a said shear pin will shear when the nozzle with which it is associated is subjected to a drag load of about 50% of the drag load that will break said nozzle.

8. A diffuser as recited in claim 6 further comprising means for limiting the amount of pivotal movement of each of said first plurality of nozzles with respect to said arm assembly in response to said high drag load so that said second end of a nozzle will not contact an annular screen.

9. A diffuser as recited in claim 8 wherein said limiting means comprises a stop pin parallel to said shear pin and vertically spaced therefrom, and a stop projection connected to said nozzle, said stop pin disposed in the arcuate path of movement of said stop projection about said pivotal connection.

10. A diffuser as recited in claim 9 wherein said stop pin is disposed about 15° from said stop projection when said shear pin is in place, for limiting the pivotal movement of its associated nozzle to about 15° from its normal vertical position.

11. A diffuser as recited in claim 3 wherein said connecting means comprises a nozzle extension having first and second ends, with a pair of first ears with aligned first through extending openings therein for receipt of a pivot pin at said first end thereof, and a second ear with a second through extending opening parallel to said first through extending openings extending from said second end thereof; said nozzle being integral within said extension.

12. A diffuser as recited in claim 11 wherein said connecting means further comprises a first portion of said arm assembly having a first ear disposed between said extension first ears, with a first through extending opening in alignment with said extension first openings; a pivot pin disposed in said first openings; a second portion of said arm assembly having at least one second ear which is adjacent said extension second ear and having a second opening in alignment with said extension second opening; and a shear pin disposed in said second openings.

13. A diffuser as recited in claim 12 wherein said arm assembly further comprises a plate, and wherein said nozzle exension has a planar surface at a vertical termination thereof; and further comprising an O-ring seal between said plate and planar surface.

14. A diffuser as recited in claim 13 wherein said nozzle is oblong in cross section, and wherein said first plurality of nozzles comprises less than all of said nozzles within said vessel.

15. A diffuser as recited in claim 12 wherein said extension second ear has a stop projection extending outwardly therefrom in said first direction of rotation; and wherein said arm assembly second portion second ear has a stop pin extending therefrom in a dimension perpendicular to said first direction of rotation.

16. A connection between an arm and a nozzle, comprising a nozzle extension having first and second ends;

a pair of first ears with aligned first through extending openings therein at said first end of said extension;

a second ear with a second through extending opening parallel to said first openings, said second ear extending from said second end of said extension;

an elongated nozzle having a first end integral with said nozzle extension, and having a second end extending outwardly from said extension in a dimension perpendicular to a plane containing said first and second openings, said nozzle second end having means defining at least one fluid introducing opening therein;

an arm having first and second portions;

said arm first portion having a first ear disposed between said extension first ears and having a first opening therein, in alignment with said extension first openings;

said arm second portion having at least one second ear which is adjacent said extension second ear and having a second opening therein, in alignment with said extension second opening;

a pivot pin received by said first openings; and a shear pin, having shear resistance properties significantly less than those of said pivot pin and said nozzle, received by said second openings, and extending parallel to sid pivot pin.

17. A connection as recited in claim 16 wherein said arm further comprises a plate, and wherein said nozzle has a planar surface at said first end thereof; and further comprising an 0-ring seal between said plate and planar surface.

18. A connection as recited in claim 17 wherein said nozzle is oblong in cross section.

19. A connection as recited in claim 16 wherein said extension second ear has a stop projection extending outwardly therefrom in said first direction of rotation; and wherein said arm second portion second ear has a stop pin extending therefrom in a dimension parallel to said second openings, said stop pin intersecting an arcuate path of movement of said stop projection about said pivot pin.

20. A method of treating paper pulp in an upright vessel having a vertical axis, a plurality of annular screens mounted on extraction arms and concentric with the vertical axis, and a plurality of treatment arms having treatment fluid introducing nozzles connected thereto by connections and disposed between the annular screens; said method comprising the steps of:

(a) introducing paper pulp so that it flows vertically in the vessel past the annular screens, liquid being withdrawn from the pulp within the vessel through the screens and extraction arms;

(b) rotating the treatment arms and attached nozzles so that the nozzles move through the pulp in a first direction of rotation, while introducing treatment fluid into the pulp through the nozzles, the treatment fluid flowing through the treatment arms into the nozzles, a drag force naturally being applied to the nozzles as they move through the pulp in the first direction of rotation;

(c) reciprocating the extraction arms, and attached screens, up and down; and (d) should the drag force on a nozzle become greater than a high predetermined value, but less than the amount of drag force that would break the nozzle, providing breaking of the connection between the nozzle and the treatment arm so that treatment fluid flows into the pulp directly from the treatment arm, rather than through the nozzle, the treatment fluid diluting the pulp at the area of breakage so as to reduce the drag force at that point.

21. A method as recited in claim 20 wherein each nozzle has a first end connected to the treatment arm, and a second end vertically remote from the first end with at least one fluid introduction opening; and wherein step (d) is practiced by causing pivotal movement of the nozzle about a pivot point at the first end thereof, so that the nozzle second end pivots opposite to the direction of rotation of the treatment arm.

22. A method as recited in claim 21 wherein step (d) is further practiced by providing limiting of the amount of pivotal movement of the nozzle so that the second end thereof will not contact a screen.

23. A method as recited in claim 22 wherein step (d) is further practiced to limit the amount of pivotal movement of the nozzle to about 15°–26°.

24. A method as recited in claim 20 wherein step (d) is practiced so that the predetermined value is about 50% of the drag force that will break the nozzle.

25. A connection between an arm and a nozzle, comprising a nozzle extension having first and second ends;

a pair of first ears with aligned first through extending openings therein at said first end of said extension;

a second ear with a second through extending opening parallel to said first openings, said second ear extending from said second end of said extension;

an elongated nozzle, oblong in cross-section, and having a first end integral with said nozzle extension, and having a second end extending outwardly from said extension in a dimension perpendicular to a plane containing said first and second openings, said nozzle second end having means defining at least one fluid introducing opening therein;

an arm having first and second portions;

said arm first portion having a first ear disposed between said extension first ears and having a first opening therein, in alignment with said extension first openings;

said arm second portion having at least one second ear which is adjacent said extension second ear and having a second opening therein, in alignment with said extension second opening;

a pivot pin received by said first openings; and a shear pin, having shear resistance properties significantly less than those of said pivot pin and said nozzle, received by said second openings.

26. A connection between an arm and a nozzle, comprising a nozzle extension having first and second ends;

a pair of first ears with aligned first through extending openings therein at said first end of said extension;

a second ear with a second through extending opening parallel to said first openings, said second ear extending from said second end of said extension;

an elongated nozzle having a first end integral with said nozzle extension, and having a second end extending outwardly from said extension in a dimension perpendicular to a plane containing said first and second openings, said nozzle second end having means defining at least one fluid introducing opening therein;

an arm having first and second portions;

said arm first portion having a first ear disposed between said extension first ears and having a first opening therein, in alignment with said extension first openings;

said arm second portion having at least one second ear which is adjacent said extension second ear and having a second opening therein, in alignment with said extension second opening;

a pivot pin received by said first openings; and a shear pin, having shear resistance properties significantly less than those of said pivot pin and said nozzle, received by said second openings;

said extension second ear having a stop projection extending outwardly therefrom in said first direction of rotation; and said arm second portion second ear having a stop pin extending therefrom in a dimension parallel to said second openings, said stop pin intersecting an arcuate path of movement of said stop projection about said pivot pin.

27. A connection as recited in claim 26 wherein said stop pin is disposed about 15°–26° from said stop projection along an arcuate path of movement of said stop projection about said pivot pin.

* * * * *